US006273865B1

(12) United States Patent
Perez

(10) Patent No.: US 6,273,865 B1
(45) Date of Patent: Aug. 14, 2001

(54) MASSAGE THERAPY CHAIR

(76) Inventor: Naomi Perez, 9910 Collins Ave. Apt. 1, Bar Harbour, FL (US) 33154

( * ) Notice: Subject to any disclaimer, the term of this patent is extended or adjusted under 35 U.S.C. 154(b) by 0 days.

(21) Appl. No.: 09/352,313

(22) Filed: Jul. 12, 1999

(51) Int. Cl.[7] ..... A61H 1/00
(52) U.S. Cl. ..... 601/49; 601/46
(58) Field of Search ..... 601/46, 48–54, 601/86–92, 97, 98, 67, 69–71, 74, 79; 297/186; 434/38, 29, 236

(56) References Cited

U.S. PATENT DOCUMENTS

| | | | | |
|---|---|---|---|---|
| 3,628,829 | * | 12/1971 | Heilig | 297/217 |
| 5,266,070 | * | 11/1993 | Hagiwara et al. | 600/27 |
| 5,401,078 | * | 3/1995 | Riach | 297/19 |
| 5,645,578 | * | 7/1997 | Daffer et al. | 607/91 |
| 5,857,986 | * | 1/1999 | Moriyasu | 601/49 |
| 5,903,395 | * | 5/1999 | Rallison et al. | 359/630 |
| 5,961,541 | * | 10/1999 | Farrati | 607/49 |
| 6,016,385 | * | 1/2000 | Yee et al. | 395/80 |

FOREIGN PATENT DOCUMENTS

| | | | | |
|---|---|---|---|---|
| 06000209 | * | 11/1994 | (JP) | 601/46 |
| 408116581 | * | 5/1996 | (JP) | 601/46 |

* cited by examiner

*Primary Examiner*—Justine R. Yu
(74) *Attorney, Agent, or Firm*—Robert J. Vanderwall

(57) ABSTRACT

A massage therapy chair includes a massage chair frame having a body support structure for supporting a user body, the body support structure including a head support structure with a face opening for receiving a user face and having a head contact surface; a forward helmet portion of a virtual reality helmet secured within the face opening to receive and extend around the user face, the forward helmet portion containing at least one virtual reality viewing screen; and a computer containing a virtual reality program and electrically connected to the forward helmet portion for delivering virtual visual images to the viewing screen. The chair preferably additionally includes a rear helmet portion of a virtual reality helmet releasibly secured to the head support structure adjacent to the head contact surface to fit over the back of a user head, the rear helmet portion containing earphones; where the rear helmet portion is electrically connected to the computer so that the computer delivers virtual sounds to the earphones corresponding to and synchronized with the virtual visual images. The rear helmet portion preferably pivots against the head support structure. The chair preferably additionally includes a diffuser for atomizing and delivering liquid aroma therapy matter secured to the massage chair frame and including a diffuser tube interconnecting the diffuser and the interior of the helmet forward portion.

10 Claims, 2 Drawing Sheets

MASSAGE THERAPY CHAIR

BACKGROUND OF THE INVENTION

1. Field of the Invention

The present invention relates generally to the field of therapy administering equipment. More specifically the present invention relates to a massage therapy chair for enhancing relaxation while a massage is performed on a user, by placing the user in a tranquil virtual reality environment which is combined with aroma and vibrating massage therapy of user extremities. The chair preferably includes a conventional massage chair frame with a posterior support structure, leg support structures, a chest support structure, an arm support structure and a head support structure with a face opening. A rearward portion of a virtual reality helmet containing ear phones is pivotally secured to the head support structure adjacent to the head contact surface to pivot over the back of the user head. A forward portion of a virtual reality helmet containing viewing screens is secured within the face opening to receive and extend around the user face when placed in the face opening. The forward and rear helmet portions are interconnected to function in unison and are connected to a computer containing a virtual reality program. A diffuser for atomizing and delivering liquid aroma therapy matter is secured to a suitable segment of the chair frame and delivers relaxing aromas to the user through a diffuser tube.

Additional features of the chair are leg and arm strap assemblies for wrapping around the user legs and arms and connected to vibrators to transmit soothing vibration into user arms and legs. The leg and arm straps are connected to or contain vibrators to relax leg and arm muscles during massage.

2. Description of the Prior Art

For some years now, there have been chair structures especially adapted to support a person while they receive a massage from a masseur and chairs for mechanically delivering a massage through a chair back rest. While these chairs have generally been suitable for delivery of the massage itself, they lack the capability to create an environment for placing the massage recipient in a relaxed state to give the massage maximum effect. The prior art has also included aroma supply mechanisms, but not within a context of administering massage therapy.

Haynes, U.S. Pat. No. 5,487,590, issued on Jan. 30, 1996, teaches a chair and method for promulgating kinesthetic therapy. Haynes includes a base independently supporting a seat frame and chest rest frame. Both extend upwardly and inwardly from the base and support a seat and chest rest above the base. An arm rest frame adjustably supports an arm rest above the base, and a head support is operatively coupled to and spaced from the chest rest. The user sits on the seat and leans forward to rest against the chest rest and his head rests against the head support, and then a massage is performed on him or her by a masseur.

Anderson, U.S. Pat. No. 5,462,516, issued on Oct. 31, 1995, teaches a cyclical action massaging chair. Anderson provides a chair with a hollow back rest containing a massage administering mechanism. The mechanism includes a longitudinal drive screw which moves a massage carriage up and down within the back rest, and wheels on the carriage bear against a flexible forward face of the back rest, and this pressure is delivered to the back of a person seated in the chair. Yamasaki, U.S. Pat. No. 5,460,598, issued on Oct. 24, 1995, and Jover, U.S. Pat. No. 5,385,531, issued on Jan. 31, 1995, both provide massage chairs generally similar to that of Anderson. Anderson, Yamasaki and Jover lack an environment for enhancing user relaxation. Riach, U.S. Pat. No. 5,177,823, issued on Jan. 12, 1993, and Riach U.S. Pat. No. 5,401,078 issued on Mar. 28, 1995, both provide an adjustable headrest. Both Riach chairs include a U-shaped pad which supports the user forehead and rearward cheek areas, exposing the face for breathing and comfort. The problems of Anderson are again presented.

Lord, U.S. Pat. No. 5,318,503, issued on Jun. 7, 1994, reveals a method and apparatus for auditory and olfactory relaxation. Lord includes means for generating and amplifying a sound at timed intervals to initiate the relaxation state and fragrance diffusion means, combined in a headset. No provision is made for incorporating this technology into means for positioning and supporting a person receiving a massage.

Machida, U.S. Pat. No. 5,023,020, issued on Jun. 11, 1991, discloses a method and apparatus for supplying aromas. Several aromatic materials are retained within respective reservoirs, and at least one such material is selected according to a predetermined time table. A predetermined amount of the selected aromatic material is diffused into the air. The apparatus includes a receptor having several aromas, a controller for controlling the receptor to select one of the aromas, and a ventilator for supplying air containing the selected aroma.

It is thus an object of the present invention to provide a massage therapy chair which fully and comfortably supports a person receiving a massage from a masseur and which places the person in an environment of sight, sound and smell which enhances relaxation.

It is another object of the present invention to provide such a chair which provides relaxing virtual reality images and sounds to the massage recipient through a helmet incorporated into the chair.

It is still another object of the present invention to provide such a chair which delivers aroma from a diffuser into the helmet.

It is finally an object of the present invention to provide such a chair which administers a vibrating massage into the limbs of a person while they receive a massage.

SUMMARY OF THE INVENTION

The present invention accomplishes the above-stated objectives, as well as others, as may be determined by a fair reading and interpretation of the entire specification.

A massage therapy chair is provided, including a massage chair frame having a body support structure for supporting a user body, the body support structure including a head support structure with a face opening for receiving a user face and having a head contact surface; a forward helmet portion of a virtual reality helmet secured within the face opening to receive and extend around the user face, the forward helmet portion containing at least one virtual reality viewing screen; and a computer containing a virtual reality program and electrically connected to the forward helmet portion for delivering virtual visual images to the viewing screen.

The chair preferably additionally includes a rear helmet portion of a virtual reality helmet releasibly secured to the head support structure adjacent to the head contact surface to fit over the back of a user head, the rear helmet portion containing earphones; where the rear helmet portion is electrically connected to the computer so that the computer delivers virtual sounds to the earphones corresponding to and synchronized with the virtual visual images. The rear helmet portion preferably pivots against the head support structure.

The chair preferably additionally includes a diffuser for atomizing and delivering liquid aroma therapy matter, the diffuser being secured to the massage chair frame and including a diffuser tube interconnecting the diffuser and the interior of the helmet forward portion to deliver an aroma into the forward helmet forward portion.

The body support structure optionally additionally includes a posterior support structure, leg support structures, a chest support structure and arm support structures. The arm support structure preferably includes an arm strap and a vibration generation mechanism, or vibrator, connected to the arm strap, so that the arm strap wraps around a user arm and the vibrator delivers vibration into the arm strap and into the user arm. The leg support structures preferably include a leg strap and a vibrator connected to the leg strap, so that the leg strap wraps around a user leg and the vibrator delivers vibration into the leg strap and into the user leg.

The massage chair frame optionally includes a rear base tube; two parallel and spaced apart, forwardly and upwardly extending first support tubes laterally connected to the base tube, the head support structure being secured across upper portions of the first support tubes; a front base tube; two parallel and spaced apart rearwardly and upwardly extending second support tubes laterally connected to the front support tube and extending adjacent and fastened to corresponding first support tubes, the posterior support structure being secured across upper portions of the second support tubes; where one of the leg support structures is connected to the first and second support tubes at each side of the massage chair frame; and where the chest support structure is secured to the first support tubes between the leg support structures and the head support structure, and the arm support structure extends forwardly from the first support tubes.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
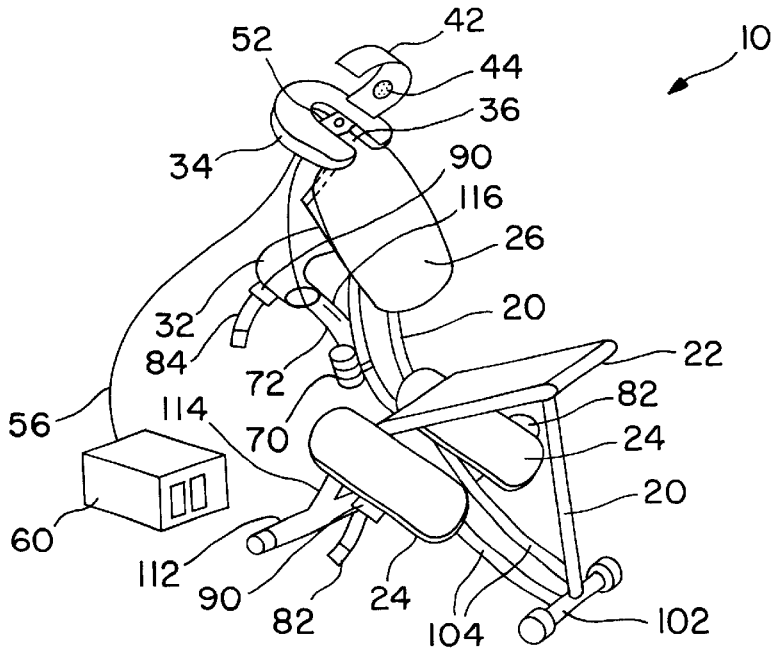
FIG. 1 is a perspective view of the complete massage chair apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

First Preferred Embodiment

Figure 2:
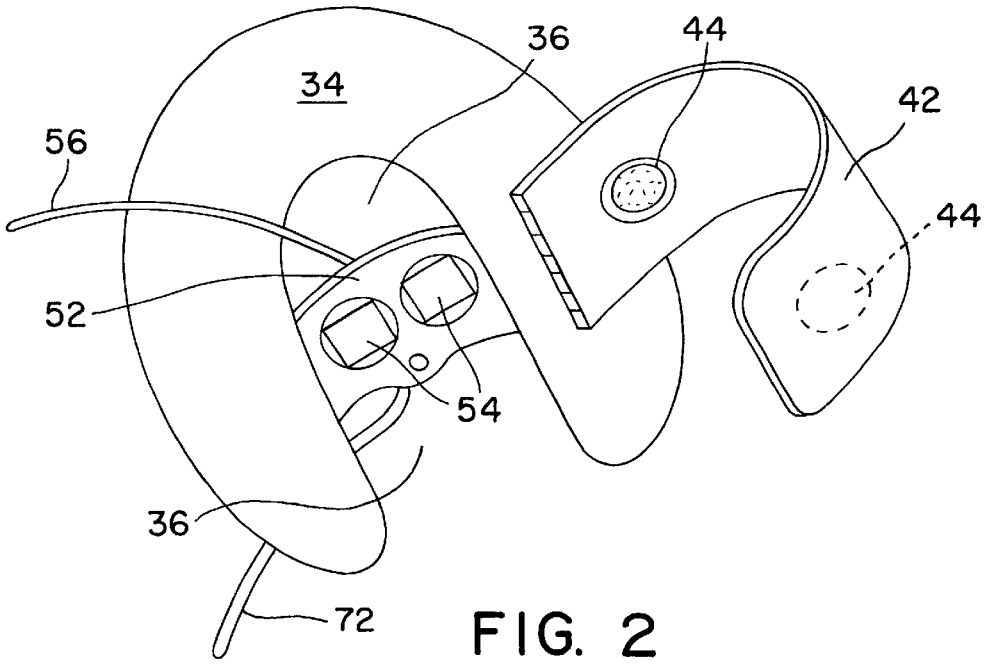
FIG. 2 is a perspective view of the head support structure and forward and rear helmet portions.
Figure 4:
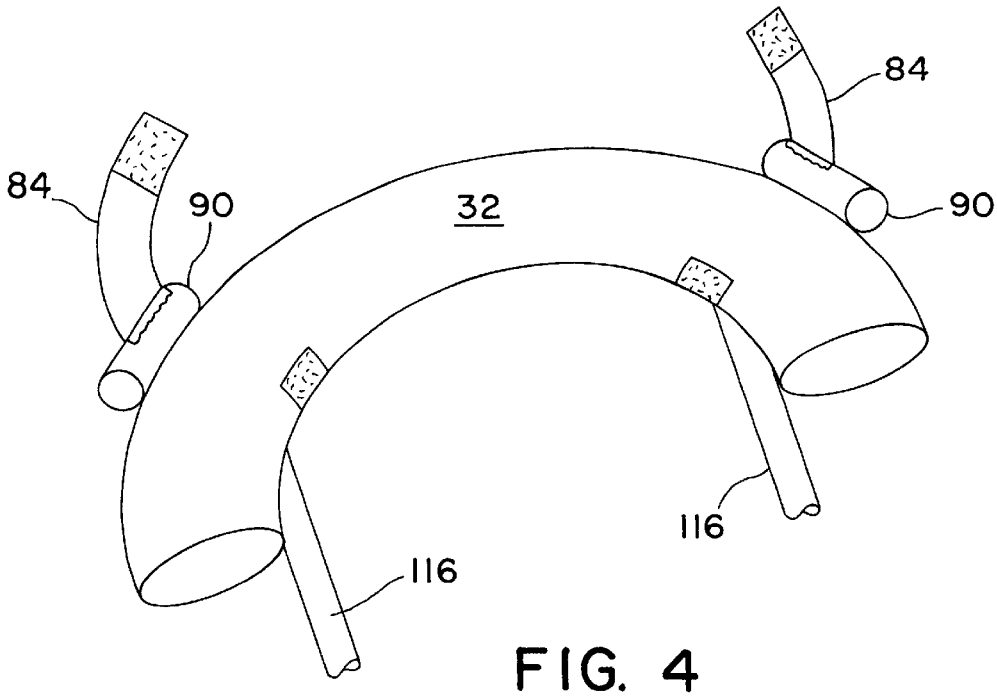
FIG. 4 is a perspective view of the arm support structure, vibrator and arm straps.
Figure 3:
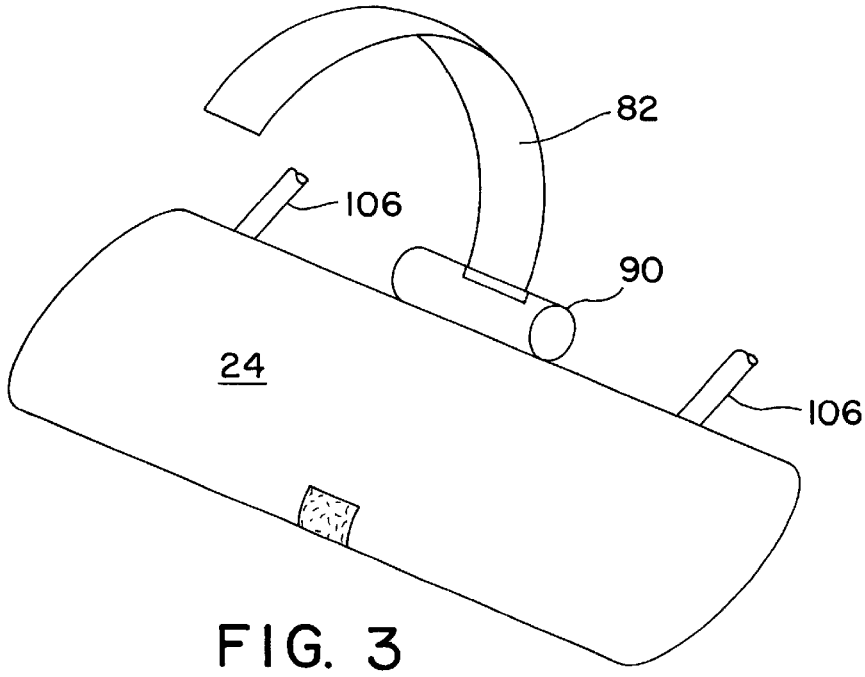
FIG. 3 is a perspective view of one of the leg support structures, a vibrator and a leg strap.

Referring to FIGS. 1–4, a massage therapy chair 10 is disclosed, including a conventional massage chair frame 20 with a posterior support structure 22, opposing leg support structures 24, a chest support structure 26, an arm support structure 32 and a head support structure 34 with a head contact surface and a face opening 36. A rear helmet portion 42 of a virtual reality helmet containing ear phones 44 is pivotally secured to head support structure 34 adjacent to the head contact surface to pivot over the back of the user head around and against head support structure 34. A separate forward helmet portion 52 of a virtual reality helmet containing viewer screens 54 is secured within face opening 36 to receive and extend around the user face when placed in opening 36, so that the user is exposed to a virtual environment which is at once relaxing to enhance massage treatment and entertaining to more pleasingly pass the time. Rear and forward helmet portions 42 and 52, respectively, are electrically interconnected to function in unison, and rear portion 42 is joined by a transmission cable 56 to a computer 60 of conventional design, which preferably runs a virtual reality program of a soothing nature.

A diffuser 70 of conventional design for atomizing and delivering liquid aroma therapy matter is secured to a suitable segment of chair frame 20. See FIG. 1. A diffuser tube 72 interconnects diffuser 70 and the interior of forward helmet portion 52 adjacent the position of the user nose to deliver pleasing and relaxing aromas to the user.

Additional features of chair 10 are vibration transmitting leg straps 82 and arm straps 84 for wrapping around the legs and arms, respectively, of the user. See FIGS. 3 and 4. Leg straps 82 and arm straps 84 are connected to or contain conventional vibrators to relax leg and arm muscles during massage. A leg strap 82 extends from and wraps over each leg support structure 24, and over each user leg, and is secured with hook and loop fasteners to the leg support structure 24. An arm strap 84 extends from and wraps over each end of the arm support structure 32 and over each user arm, and is also secured with hook and loop fasteners to arm support structure 32. Each leg strap 82 and each arm strap 84 is preferably connected in tension to a vibrator 90 of conventional design including an electric motor contained within a housing and drivably connected to an eccentrically mounted flywheel. Rapid rotation the eccentrically mounted flywheel produces vibration of the motor and housing, which is transmitted through the strap and largely dissipated within the user arm or leg.

Chair frame 20 is preferably of generic design, such as that of the PORTAL PRO 2™ chair, and includes a rear base tube 102 laterally connected to two parallel and spaced apart, forwardly and upwardly arching first support tubes 104 having the head support structure 34 secured across their upper ends. A front base tube 112 is laterally connected to two parallel and spaced apart rearwardly and upwardly arching second support tubes 114 which extend between and are fastened to corresponding and adjacent first support tubes 104, and the posterior support structure 22 is secured across their upper ends. A leg support structure 24 is provided on each side of chair frame 20 and extends laterally from first and second support tubes 104 and 114, respectively, on forward and rearward leg support struts 106. A rearward facing chest support structure 26 is secured to the first support tubes 104 between leg support structures 24 and head support structure 34, and arm support structure 32 extends forwardly from first support tubes 104 on arm support struts 116. All support structures are preferably padded. Positions of various parts of chair frame 20 can be loosened, moved relative to other parts and re-secured to adjust the relative positions of the several user support structures.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A massage therapy chair, comprising:

a massage chair frame having body support structure for supporting a user body, said body support structure comprising a head support structure with a face opening for receiving a user face and having a head contact surface; at least one leg strap and vibrator connected to said leg strap mounted on the frame, such that said leg strap wraps around a user leg and said vibrator delivers vibration into said leg strap and into the user leg;

a virtual reality helmet secured within said face opening and having a forward helmet portion to receive and extend around the user face containing at least one virtual reality viewing screen and earphones; and a computer containing a virtual reality program and electrically connected to said forward helmet portion for delivering virtual visual images to said viewing screen and virtual sounds to the earphones corresponding to and synchronized with the virtual visual images.

2. The chair of claim 1, additionally comprising:

a rear helmet portion of a virtual reality helmet releasibly secured to said head support structure adjacent to the head contact surface to fit over the back of a user head, said rear helmet portion containing earphones;

wherein said rear helmet portion is electrically connected to said computer such that said computer delivers virtual sounds to said earphones corresponding to and synchronized with said virtual visual images.

3. The chair of claim 2, wherein said rear helmet portion pivots against said head support structure.

4. The chair of claim 1, additionally comprising a diffuser for atomizing and delivering liquid aroma therapy matter, said diffuser being secured to said massage chair frame and comprising a diffuser tube interconnecting said diffuser and said helmet forward portion to deliver an aroma into said forward helmet forward portion.

5. The chair of claim 1, which further comprises at least one arm strap and a vibrator connected to said arm strap mounted on the frame, such that said arm strap wraps around a user arm and said vibrator delivers vibration into said arm strap and into the user arm.

6. The chair of claim 1, wherein said massage chair frame comprises:

a rear base tube;

two parallel and spaced apart, forwardly and upwardly extending first support tubes laterally connected to said base tube, said head support structure being secured across upper portions of said first support tubes;

a front base tube;

two parallel and spaced apart rearwardly and upwardly extending second support tubes laterally connected to said front support tube and extending adjacent and fastened to corresponding first support tubes, said posterior support structure being secured across upper portions of said second support tubes;

wherein one said leg support structure is connected to said first and second support tubes at each side of said massage chair frame;

and wherein said chest support structure is secured to said first support tubes between said leg support structures and said head support structure, and said arm support structure extends forwardly from said first support tubes.

7. A massage therapy chair, comprising:

a frame;

at least one leg strap and vibrator connected to said leg strap mounted on the frame, such that said leg strap wraps around a user leg and said vibrator delivers vibration into said leg strap and into a user leg;

a head support structure mounted on the frame and having a head contact surface;

a forward helmet portion of a virtual reality helmet secured to said head support structure and positioned to extend over a user face when a user head rests against said head contact surface, said forward helmet portion containing at least one virtual reality viewing screen; and a computer containing a virtual reality program and in electrical communication with said forward helmet portion for delivering virtual visual images to said viewing screen.

8. The chair of claim 7, additionally comprising:

a rear helmet portion of a virtual reality helmet releasibly secured to said head support structure adjacent to the head contact surface to fit over the back of a user head, said rear helmet portion containing earphones;

wherein said rear helmet portion is electrically connected to said computer such that said computer delivers virtual sounds to said earphones corresponding to and synchronized with said virtual visual images.

9. A massage therapy chair, comprising:

a massage chair frame having body support structure for supporting a user body, said body support structure including a head support structure with a face opening for receiving a user face and having a head contact surface;

at least one leg strap and vibrator connected to said leg strap mounted on the frame, such that said leg strap wraps around a user leg and said vibrator delivers vibration into said leg strap and into the user leg;

at least one arm strap and vibrator connected to said arm strap mounted on the frame, such that said arm strap wraps around a user arm and said vibrator delivers vibration into said arm strap and into the user arm;

a virtual reality helmet secured within said face opening and having a forward helmet portion to receive and extend around the user face and containing at least one virtual reality viewing screen and earphones;

a computer containing a virtual reality program and electrically connected to said forward helmet portion for delivering virtual visual images to said viewing screen and virtual sounds to the earphones corresponding to and synchronized with the virtual visual images; and a diffuser mounted on the frame for atomizing and delivering liquid aroma therapy matter comprising a diffuser tube interconnecting said diffuser and the interior of said helmet forward portion to deliver an aroma into said forward helmet forward portion.

10. The chair of claim 9, wherein said massage chair frame further comprises:

a rear base tube;

two parallel and spaced apart, forwardly and upwardly extending first support tubes laterally connected to said base tube, said head support structure being secured across upper portions of said first support tubes;

a front base tube;

two parallel and spaced apart rearwardly and upwardly extending second support tubes laterally connected to said front support tube and extending adjacent and fastened to corresponding first support tubes, said posterior support structure being secured across upper portions of said second support tubes;

wherein one said leg support structure is connected to said first and second support tubes at each side of said massage chair frame;

and wherein said chest support structure is secured to said first support tubes between said leg support structures and said head support structure, and said arm support structure extends forwardly from said first support tubes.

* * * * *